US006168390B1

(12) United States Patent
Hunklinger et al.

(10) Patent No.: US 6,168,390 B1
(45) Date of Patent: Jan. 2, 2001

(54) DOSING PUMP FOR DOSED LIQUID CONVEYANCE

(75) Inventors: Herbert Hunklinger, Ruhrpolding; Klaus Rutz, Vachendorf, both of (DE)

(73) Assignee: Henkel Kommanditgesellschaft Auf Aktien, Duesseldorf (DE)

( * ) Notice: Under 35 U.S.C. 154(b), the term of this patent shall be extended for 0 days.

(21) Appl. No.: 09/381,672

(22) PCT Filed: Mar. 13, 1998

(86) PCT No.: PCT/EP98/01458

§ 371 Date: Oct. 22, 1999

§ 102(e) Date: Oct. 22, 1999

(87) PCT Pub. No.: WO98/42983

PCT Pub. Date: Oct. 1, 1998

(30) Foreign Application Priority Data

Mar. 22, 1997 (DE) ..... 197 12 096

(51) Int. Cl.[7] ..... F04B 49/00
(52) U.S. Cl. ..... 417/299
(58) Field of Search ..... 417/299, 307, 417/302, 283, 510, 442

(56) References Cited

U.S. PATENT DOCUMENTS 4,865,525 * 9/1989 Kern ..... 417/307
4,951,701 8/1990 Boehmer .
4,990,066 * 2/1991 Kern ..... 417/307
5,492,449 * 2/1996 Hunklinger et al. ..... 417/259
5,588,809 12/1996 Klein et al. .
5,871,566 * 2/1999 Rutz ..... 96/6

FOREIGN PATENT DOCUMENTS 457 146 7/1968 (CH) .
42 19 663 12/1993 (DE) .
42 41 030 6/1994 (DE) .
2 177 183 1/1987 (GB) .

* cited by examiner

*Primary Examiner*—Philip H. Leung
*Assistant Examiner*—Vinod D Patel
(74) *Attorney, Agent, or Firm*—Kenneth Watov; Glenn E. J. Murphy; Wayne C. Jaeschke

(57) ABSTRACT

A dosing pump for dosed liquid conveyance that includes a suction valve built into a suction tube coming out of a suction container, a pump chamber having a displacement volume that can be modified by means of a pumping member, a pressure valve leading to a dosing tube, a deaeration device arranged on the top end of the tube and comprising a return valve and a flow-actuated deaeration and bypass valve built into a deaeration valve having response characteristics dependent upon the state of aggregation of the liquid contained therein. The flow-activated deaeration and bypass valve is open when idle, only closing when pressure is raised in the presence of liquid in the valve, and is provided with a membrane. Faulty pump operation is substantially reduced when the membrane is connected to a remote closing member which closes the deaeration tube when the membrane is moved. A return valve is arranged between the membrane and the closing member.

11 Claims, 4 Drawing Sheets

DOSING PUMP FOR DOSED LIQUID CONVEYANCE

BACKGROUND 1.0. Field of the Invention

This invention relates generally to a feed pump for conveying liquids in dosed amounts, and more particularly to such a feed pump including a mechanism for dearerating the liquid as it is pumped. The pump comprises a suction valve built into an intake line coming from an intake container; a pump chamber behind the suction valve of which the displacement volume can be changed by a pump element; a pressure valve leading to the feed line, a venting device with a nonreturn valve arranged at the upper end of the pump; and a flow-actuated vent and bypass valve which is built into a vent line and of which the response behavior depends on the aggregate state of the fluid bearing against it, this valve being opened in the inoperative position and closed only during the compression stroke when liquid is bearing against the valve and comprising an elastic membrane.

2.0. Discussion of Related Art

In a known such feed pump as described above, the membrane of the vent valve has an opening acting as a flow restrictor with such a diameter that, when gases flow through, the membrane is not deflected, but moves when liquid bears against the membrane during the compression stroke so that the valve outlet is closed. In this way, the liquid in the pump chamber is able to release the gas present in it to the vent line both during the compression stroke and during the suction stroke. When the liquid has been fully deaerated, however, the membrane closes so that very little liquid enters the vent line.

Gases are prevented from flowing back into the pump chamber from the vent line by a nonreturn valve which is arranged behind the membrane in the vent path. During venting, a small amount of liquid always flows through the nonreturn valve into the vent line and back to the intake container. After venting, the nonreturn valve wetted with liquid is surrounded by gas or air, the liquid gradually drying off. Difficulties frequently arise at this stage because the partly dried residues of liquid cause the valve element to adhere firmly to the seat of the nonreturn valve, especially where the liquid has a tendency to crystallize. When it comes to the next venting cycle, the gas pressure on the nonreturn valve is generally not sufficient to open the valve.

Another known feed pump for conveying liquids in dosed amounts is also has a vent and return line to the intake container. However, the venting valve is arranged within the flow path from the pump chamber to the liquid outlet. When the liquid is deaerated, the vent line is closed by a closure element which is connected by supporting arms to a control membrane. Provided between the control membrane and the closure element is a nonreturn valve which is referred to as a "central nonreturn valve". The vent valve is dependent only upon the pressure acting on the membrane and not upon the aggregate state of the fluid bearing against it. In this known pump, the venting rate is determined by the size of the control membrane.

3.0. Summary of the Invention

An object of the present invention is to significantly reduce the tendency of a pump of the type mentioned above to become inoperative.

In one embodiment of the invention, the membrane is connected to a closure element which is arranged at a distance therefrom, and which closes the vent line when the membrane is deflected. Also, the valve is arranged between the membrane and the closure element.

In contrast to the first known pump, the membrane of the pump according to one embodiment of the invention does not act simultaneously as a closure element, but only as a control element for such an element. The nonreturn valve is arranged in the space between the membrane and the closure element so that its valve element, for example a ball, is always surrounded by liquid when the liquid is dearated and the vent line thus closed. In this manner, the valve element is unable to stick fast to the valve seat, even in the event of prolonged operation of the pump with dearated liquid. The space between the membrane and the closure element remains filled with the liquid until non-dearated liquid is taken in again, the membrane returns to its rest position and the closure element thus opens the vent line so that the gas can escape.

During the suction stroke in the case of deaerated liquid, the membrane moves back into its starting position and the closure element opens the vent line. In this case, however, air or gases is/are prevented from flowing back by the nonreturn valve. The constant movement of the membrane which takes place even with deaerated liquid—in contrast to the first known pump, prevents the membrane from seizing and contributes towards operational reliability.

Since small quantities of liquid flow off through the vent line during venting and during the change in pressure from the suction to the compression stroke, it is of advantage if the vent line returns to the intake container.

The membrane is kept in this starting position by its own bias or alternatively or additionally via a spring. The response threshold of the valve is determined by this force. This threshold is selected so that the membrane is only active in the presence of dearated liquid in the pump chamber.

A particular advantage of the feed pump according to the invention is that venting is particularly rapid because, with non-deaerated liquid, no control force has to be applied to the membrane to open the vent line. All that is needed is the relatively weak control force on the nonreturn valve.

The dependence of the response behavior of the vent valve upon the aggregate state of the liquid bearing against it is preferably achieved by the membrane forming a continuous surface except for a flow-restricting bore. The diameter of this bore is adapted to the liquid and to the biasing of the membrane, so that the bore forms a sufficiently high flow resistance for the liquid and the membrane is activated during the compression stroke. For gas bearing against the vent valve, the flow resistance is too low to lift the membrane off its seat.

BRIEF DESCRIPTION OF THE DRAWINGS

Various embodiment of the invention are described in detail in the following with reference to the accompanying drawings, wherein.

In all the drawings, the same reference numerals have the same meanings and, accordingly, may only be explained once.

DETAILED DESCRIPTION OF THE INVENTION

Figure 1:
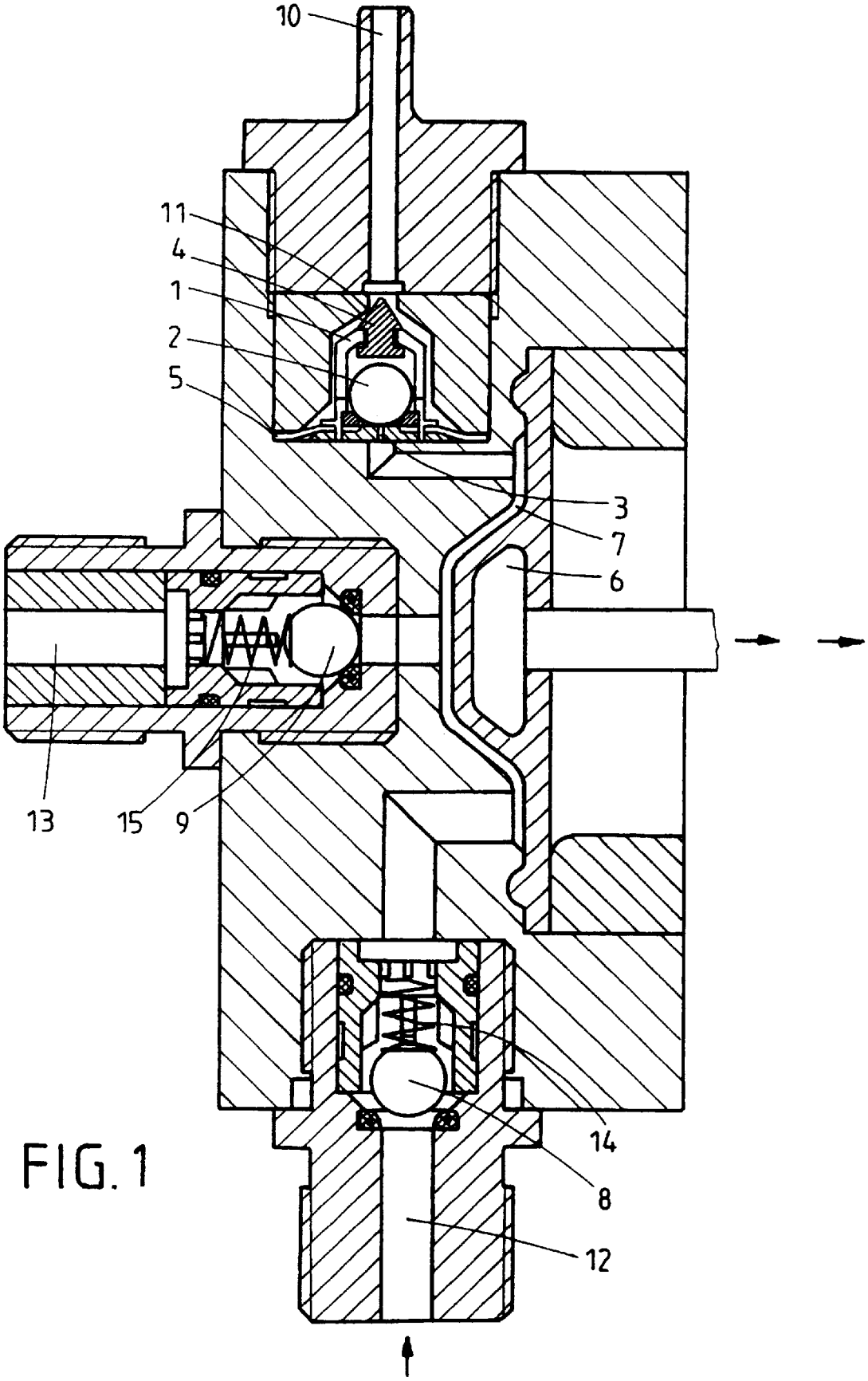
FIG. 1 is a longitudinal section through the feed pump according to one embodiment of the invention in the suction position.

The piston pump has an intake line 12 which is connected to an intake container (not shown) for the liquid to be conveyed, a feed line 13 and an inner pump chamber 7 arranged between the two lines. For pumping, a diaphragm 6 which changes the volume of the pump chamber 7 is moved in the direction of the arrows by a motor (not shown). Provided at the inlet end of the intake line 12 is a suction valve of which the valve element 8—in the form of a ball—is held in its closed position by a compression spring 14. A corresponding feed valve at the inlet end of the feed line 13 also has a valve ball 9 which is pressed onto its valve seat by a compression spring 15.

In the upper part of the pump, the pump chamber 7 is connected to a venting device which is returned to the intake container (not shown) by a vent line 10.

Figure 2:
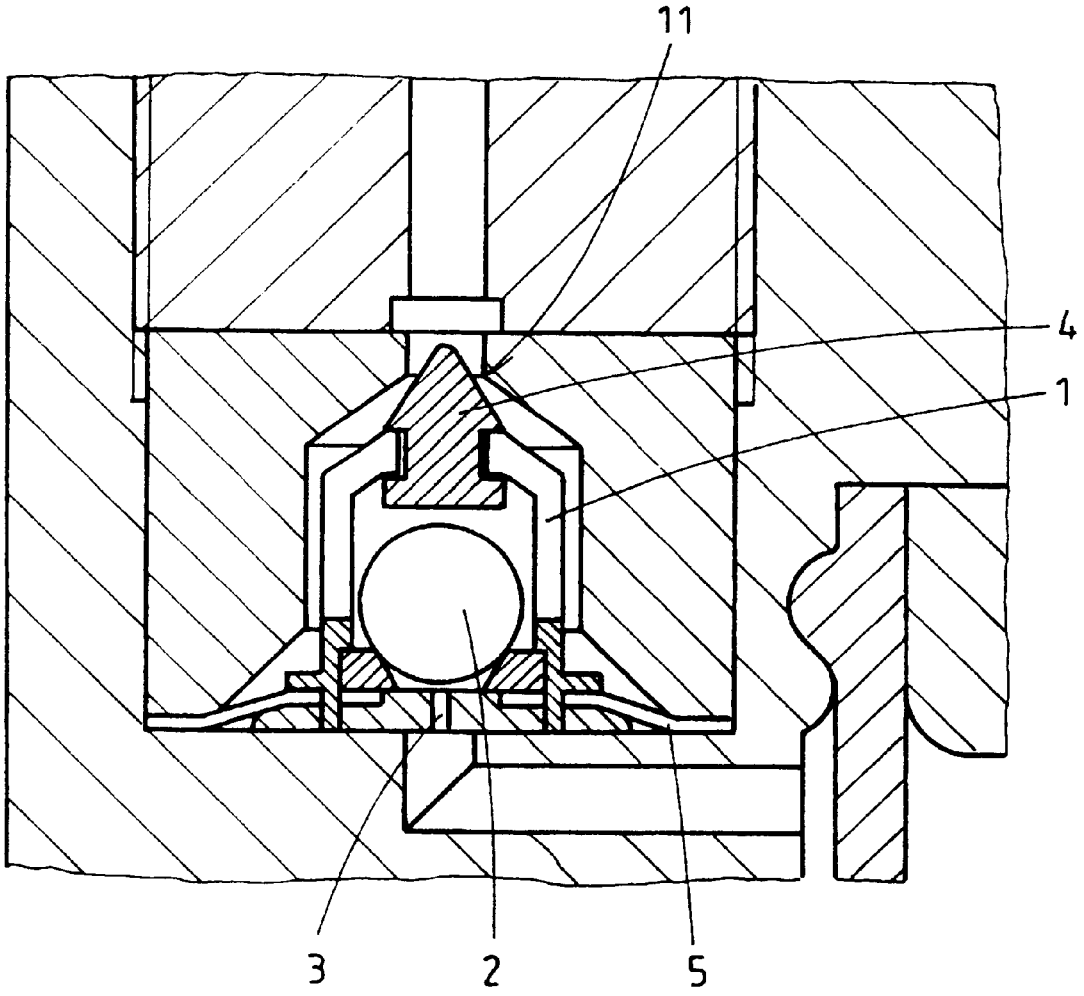
FIG. 2 is an enlarged view of the venting part of the pump shown in FIG. 1, again in the suction position.

The venting device is shown on an enlarged scale in FIG. 2. It comprises two valves, a membrane valve and a nonreturn valve with a valve ball 2. The membrane valve consists of a membrane 5 with a through-bore 3 acting as a flow restrictor. The membrane 5 serves as an actuator for a closure element 4 which is connected to membrane 5 by supporting arms 1, and which forms the actual valve element. The nonreturn valve is arranged between the membrane 5 and the closure element 4.

Further details will become clear from the following operational description. At the beginning of the feed cycle in the suction position, the membrane 5 is in its rest position under the effect of its own biasing and, optionally, the force of a compression spring, and lies flat on its valve seat. The ball 2 of the nonreturn valve closes the bore 3 in the membrane. At the same time, however, the closure element 4 is lifted off its valve seat 11 and opens the vent line 10. The movement of the diaphragm 6 to the right (FIG. 1) increases the volume of the pump chamber 7, the valve ball 8 of the intake valve lifts itself off its valve seat against the compression spring 14 and liquid, air or both is/are drawn into the pump chamber 7. The pressure valve 9 is closed. The reduced pressure in the pump chamber 7 acts on the relatively large area of the membrane 5 and in the direction in which the membrane 5 is biased, so that the membrane 5 remains in its rest position.

Figure 3:
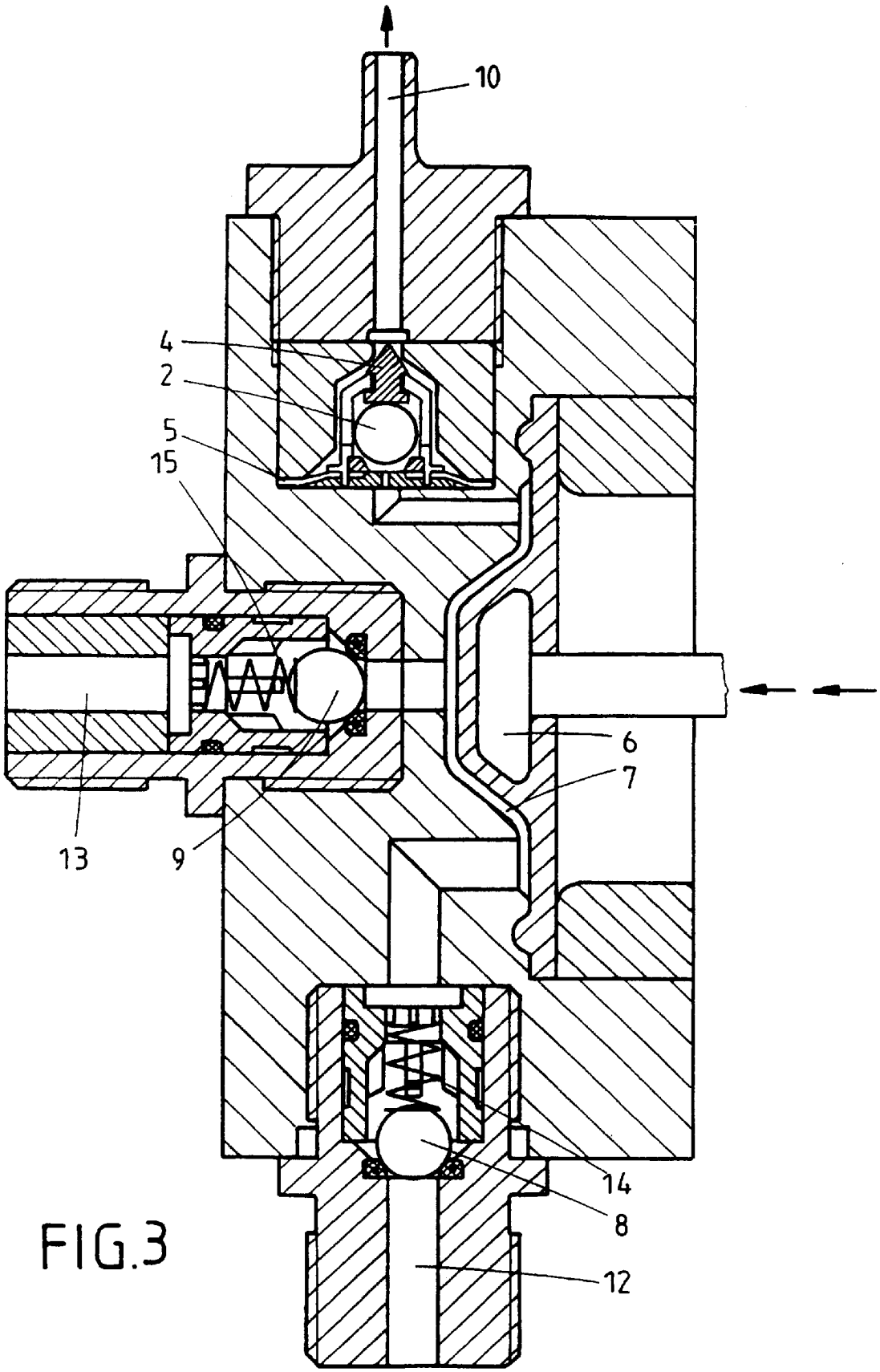
FIG. 3 shows the pump in the vent position.

During the following compression stroke (FIG. 3), the diaphragm 6 moves to the left and reduces the volume of the pump chamber 7, the valve 8 responds by closing. Because of the air present in the liquid, the pressure is not yet sufficient to open the feed valve 9 against the force of the compression spring 15 and any back-pressure coming from the feed line 13. The air present in the pump chamber 7 flows upwards to the membrane 5, lifts the valve ball 2 and escapes into the vent line 10 via the closure element 4 which opens the line 10. The bore 3 in the membrane 5 has such a diameter that the back-pressure created by the flowing air is not sufficient to lift the membrane 5. Accordingly, the vent line 10 is permanently open during this venting phase and no gas pressure can occur in the system, for example through outgassing liquids. Venting advantageously takes place in the absence of pressure and with no lost space ("dead space") of the membrane 5. Accordingly, venting is quick and safe.

Figure 4:
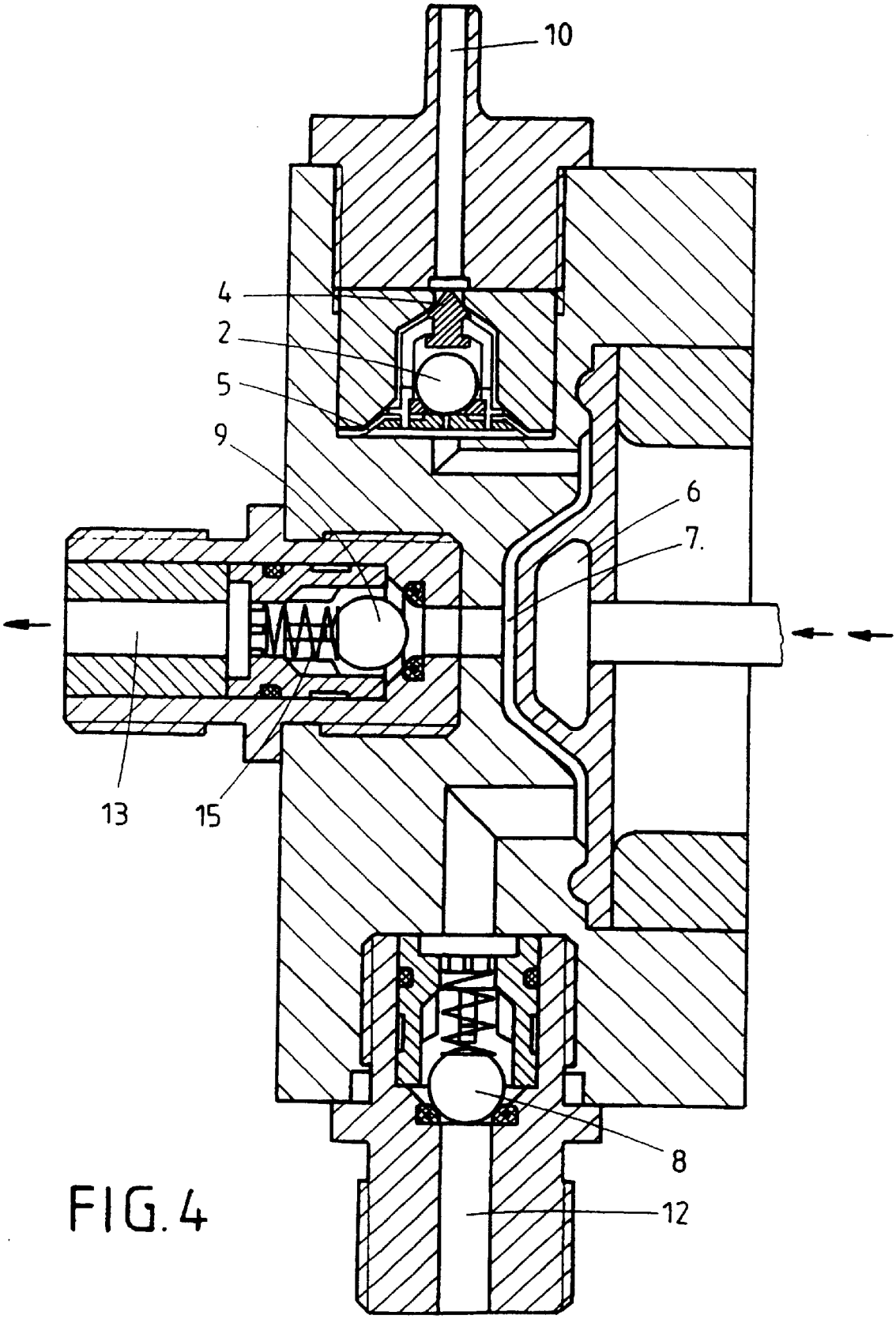
FIG. 4 shows the pump in the feed position.

FIG. 4 shows the pressure position of the feed pump with the pump head vented. The valve ball 8 of the intake valve is again closed. Under the effect of the relatively high back-pressure of the liquid in the flow-restricting bore 3 of the membrane 5, the membrane 5 lifts itself upwards off its seat and presses the closure element 4 against its seat 11 (FIG. 2) so that the vent line 10 is closed. The volume of the pump chamber 7 increases in accordance with the area of the membrane 5 and its movement. After the vent line 10 has been closed, the valve ball 9 of the feed valve lifts itself off its seat against the force of the compression spring 15 because, with the pump chamber 7 completely filled with deaerated liquid, an adequate pressure now acts on the ball 9. The liquid is delivered into the feed line 13.

During the subsequent suction stroke, the membrane 5 moves downwards with the nonreturn valve closed and increases the volume of the pump chamber 7. Accordingly, any loss through the venting device only occurs in the vented state By contrast, when gas is present in the pump chamber 7, the intake force experiences a kind of self-increasing effect. Also of importance is the relatively large membrane area on which the forces act to prevent the closure element 4 from sticking fast to the seat 11.

List of reference numerals

1 supporting arm
2 valve ball
3 bore
4 closure element
5 membrane
6 diaphragm (pumping element)
7 pump chamber
8 valve element of the intake valve
9 valve ball of the feed valve
10 vent line
11 valve seat
12 intake line
13 feed line
14 compression spring
15 compression spring

What is claimed is:

1. A feed pump for conveying liquids in dosed amounts comprising a suction valve built into an intake line coming from an intake container; a pump chamber behind the suction valve of which the displacement volume can be changed by a pumping element; a pressure valve leading to the feed line, a venting device with a nonreturn valve arranged at the upper end of the pump; and a flow-actuated vent and bypass valve which is built into a vent line and of which the response behavior depends on the aggregate state of the fluid bearing against it, this valve being opened in the inoperative position and closed only during the compression stroke when liquid is bearing against the valve and comprising an elastic membrane, wherein the membrane is connected to a closure element which is arranged at a distance therefrom and which closes the vent line when the membrane is deflected and in that the nonreturn valve is arranged between the membrane and the closure element.

2. A feed pump as claimed in claim 1, wherein the vent line returns to the intake container.

3. A feed pump as claimed in claim 2, wherein the membrane is biased in its rest position.

4. A feed pump as claimed in claim 2, wherein the membrane is held in its rest position by a spring.

5. A feed pump as claimed in claim 2, wherein the membrane forms a continuous surface except for a flow-restricting bore.

6. A feed pump as claimed in claim 1, wherein the membrane is biased in its rest position.

7. A feed pump as claimed in claim 6, wherein the membrane is held in its rest position by a spring.

8. A feed pump as claimed in claim 6, wherein the membrane forms a continuous surface except for a flow-restricting bore.

9. A feed pump as claimed in claim 1 wherein the membrane is held in its rest position by a spring.

10. A feed pump as claimed in claim 9, wherein the membrane forms a continuous surface except for a flow-restricting bore.

11. A feed pump as claimed in claim 1, wherein the membrane forms a continuous surface except for a flow-restricting bore.

* * * * *